US006142454A

United States Patent [19]

Aronsson et al.

[11] Patent Number: 6,142,454

[45] Date of Patent: Nov. 7, 2000

[54] DIAPHRAGM CARBURETOR

[75] Inventors: Tore Aronsson, Mölndal; Bo Carlsson, Floda; Ove Donnerdal, Sävedalen; Magnus Söderqvist, Mölndal, all of Sweden

[73] Assignee: Aktiebolaget Electrolux, Stockholm, Sweden

[21] Appl. No.: 09/077,176

[22] PCT Filed: Nov. 29, 1996

[86] PCT No.: PCT/SE96/01576

§ 371 Date: May 21, 1998

§ 102(e) Date: May 21, 1998

[87] PCT Pub. No.: WO97/20138

PCT Pub. Date: Jun. 5, 1997

[30] Foreign Application Priority Data

Nov. 29, 1995 [SE] Sweden ..... 9504265

[51] Int. Cl.[7] ..... F02M 17/04

[52] U.S. Cl. ..... 261/35; 261/69.1; 261/DIG. 68

[58] Field of Search ..... 261/35, 69.1, 69.2, 261/DIG. 68

[56] References Cited

U.S. PATENT DOCUMENTS

| | | | |
|---|---|---|---|
| 3,037,751 | 6/1962 | Phillips | 261/35 |
| 3,045,605 | 7/1962 | Nutten et al. | 261/35 X |
| 3,065,957 | 11/1962 | Phillips | 261/35 |
| 3,174,732 | 3/1965 | Brown | 261/69.2 |
| 3,236,505 | 2/1966 | Phillips | 261/42 |
| 3,275,306 | 9/1966 | Phillips | 261/35 |
| 4,294,779 | 10/1981 | Alape | 261/DIG. 68 |
| 5,073,307 | 12/1991 | Langer et al. | 261/35 |

FOREIGN PATENT DOCUMENTS 1296030 5/1962 France .

OTHER PUBLICATIONS

Derwent's abstract, No. 87–35658/05, week 8705, Abstract of SU 1236137 (MECH ENG WKS DZERZH), Jun. 7, 1986, abstract, fig.

*Primary Examiner*—Richard L. Chiesa
*Attorney, Agent, or Firm*—Pearne & Gordon LLP

[57] ABSTRACT

A diaphragm carburetor having a carburetor casing defining a mixing passage. A measuring chamber is disposed in the carburetor casing and is partitioned into a fuel chamber and a compensation chamber separated by a control diaphragm. The compensating chamber is closed to the surrounding atmosphere but is connected to a channel. An opening of the channel enters into a space between the air filter and a fuel inlet in the mixing passage. The channel is at least partially defined by a pipe extending through the carburetor casing. The pipe is adapted for assembly/disassembly from outside of the casing. The pipe is attached to a spacer for properly orienting and fixing the pipe relative to the casing during assembly.

20 Claims, 5 Drawing Sheets

DIAPHRAGM CARBURETOR

This is the U.S. national stage application of international application PCT/SE96/01576 filed on Nov. 29, 1996.

BACKGROUND OF THE INVENTION

The present invention relates to a diaphragm carburetor, more particularly for two-stroke motors, with a mixing passage connected at the inlet side to an air filter, the air being sucked in from the inlet side and the fuel being sucked in from a fuel chamber, said fuel chamber being partitioned off by a control diaphragm A number of compensating arrangements for diaphragm carburetors for two-stroke motors in particular, as well as chain saws, clearance saws, cutting-off machines etc. have been produced. The diaphragm partitions a space, often called the measuring chamber, in the carburettor into a chamber containing fuel and a chamber containing air, hereinafter called the compensating chamber. The fuel chamber is connected on one hand to the fuel supply and on the other hand to the mixing passage of the carburettor via distributors.

The compensation is primarily intended for altering the mixing conditions when the air filter is being polluted. The increasing pollution of the filter causes an increased vacuum on the inlet side of the mixing passage. Further, the amount of combustion air decreases with an increase of the degree of pollution, leading to a richer fuel/air mix, i.e. the amount of fuel increases with respect to the amount of air. A richer mix leads to incomplete combustion and a loss of power of the engine.

In order to compensate for this, the diaphragm in the carburettor is controlled by the increased vacuum in the space between the filter and carburettor through a passage between them. In some cases the passage comprises an external hose with consequent problems of leakage at the connections, breakage of the hose etc. Other solutions for the passage have involved including it in the carburettor casing through small drilled holes in the material. Some passages are closed with pieces of pipe impressed in the carburettor casing in order to obtain the inlet to the passage in the middle of the mixing passage. The pipe inlet is often directed against the direction of flow in the mixing passage in order to obtain as great a pressure difference as possible between both sides of the control diaphragm, fuel chamber and compensating chamber.

Tests of compensating passages have shown that in certain cases it is necessary to introduce chokes into the passages in order to level out the pressure variations which occur in the suction system. Here there is also the problem of arranging these chokes, which is often done by pressing small throttling bushing into the compensating passages. This too is relatively complicated.

As it is very difficult to determine theoretically how the compensating passages should be designed for each type of motor and filter arrangement, one is largely forced to try them out. This means that the design of the passage in or on the carburetor, and the size and location etc. of the chokes may need to be changed.

Another aspect is that one type of carburetor is used for motors with different passage design requirements. The adjustment of the carburettor takes place by setting and/or changing adjusting screws in accordance with the mixing conditions. However it is not certain that the same design of compensating passage and possible chokes is suitable for the different motor and filter arrangements. This means that factory-made carburettors have to be configured for a specific motor type/area of application which in turn results in increased production and spare parts costs.

SUMMARY OF THE INVENTION

The aim of the invention is to produce a diaphragm carburetor which is able to compensate for contamination of the air filter in such a way that the fuel mixture is substantially kept constant right up to very high levels of contamination comprising compensating passages between the compensating chambers and the suction side of the carburettor, where the passage is easy to assemble, prevents leaks and is easy to adapt to different types of motor and areas of application.

According to one aspect of the invention this aim is achieved by means of a diaphragm carburettor for, in particular, two-stroke motors with a carburettor casing having a mixing passage connected on the inlet side to an air filter and a measuring chamber arranged in the casing, said measuring chamber being partitioned into a fuel chamber and a compensating chamber separated by a control diaphragm, whereby air is sucked in from the inlet side and fuel is sucked in from the fuel chamber into the mixing passage, that the compensating chamber is closed off vis-à-vis the surrounding atmosphere but connected to the mixing passage via a channel with an opening arranged before the fuel inlets in the direction of flow in the mixing passage, and that the opening of the channel or its connection with the mixing passage is directed towards the direction of flow, characterised in that said channel is arranged in a pipe which can be assembled from outside and controlled by rotation, and which extends through the carburettor casing.

According to one aspect of the invention this is achieved with a diaphragm carburettor, more particularly for two-stroke motors with a carburettor casing having a mixing passage connected at the inlet side to an air filter, and a measuring chamber arranged in the casing, said measuring chamber being partitioned into a fuel chamber and a compensating chamber separated by a control diaphragm, whereby air is sucked in from the inlet side and fuel is sucked in from the fuel chamber into the mixing passage, in such a way that the compensating chamber is closed to the surrounding atmosphere but is connected to a channel with an opening entering out into the space between the air filter and the fuel inlet (28) in the mixing passage, characterised in that one section of the channel is integrated into a suction pipe arranged between the carburettor and the air filter, and in that the opening of the channel enters into the suction pipe.

These, and other features of the invention can be achieved by what has been characterised in the following claims. Further characteristics and aspects of the invention are set out in the following description of a preferred embodiments of the invention.

DESCRIPTION OF THE DRAWINGS

A preferred embodiment of the invention is described in conjunction with the attached drawings, where.

DETAILED DESCRIPTION OF THE PREFERRED EMBODIMENTS

Figure 1:
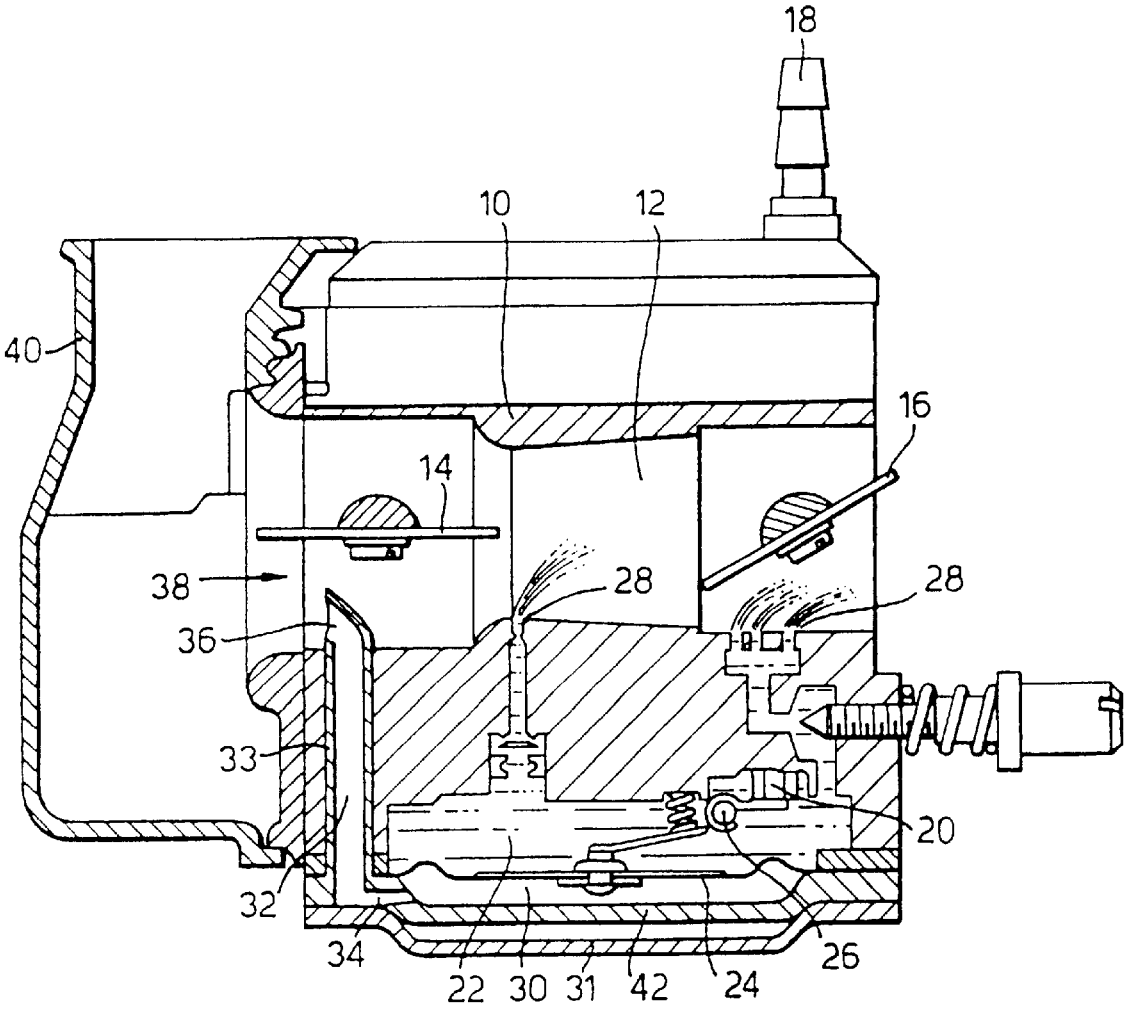
FIG. 1 shows a side view in cross section of a diaphragm carburettor with an first embodiment of a compensating unit.
Figure 2:
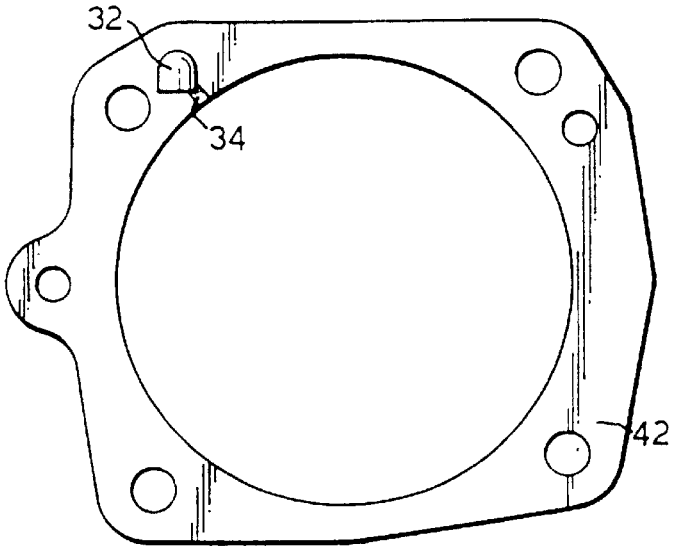
FIG. 2 shows a planar view of a plastic spacer with an integrated compensating channel in accordance with the embodiment of FIG. 1.

The diaphragm carburetor shown in FIG. 1 comprises a carburettor casing 10 The carburettor casing 10 comprises a continuous mixing passage 12 in which a choke throttle 14 and an acceleration throttle 16 are arranged. Arranged in the carburettor casing there is a diaphragm pump (not shown) which pumps fuel via inlet 18 and a needle valve 20 into a measuring chamber pertained by a control diaphragm 24 of a certain diaphragm area, the space with the fuel being named the fuel chamber 22. Movement of the needle valve 20 is controlled by the control diaphragm 24 via a lever construction 26. The fuel chamber 22 is linked to mixing passages 12 via a number of distributors 28.

On the opposite side of the diaphragm 24 in the measuring chamber there is a space named the compensating chamber 30. The compensating chamber 30 is closed to the surrounding environment by means of a cover 31. A channel 32, here after named compensating channel, is connected to the chamber 30, in the form of a pipe 33 which extends through the carburettor casing, in the shown embodiment largely perpendicularly to the mixing passage 12 and entering into the mixing passage. In the illustrated embodiment the compensating pipe 33 extends a distance into the mixing passage 12 seen radially.

Figure 4:
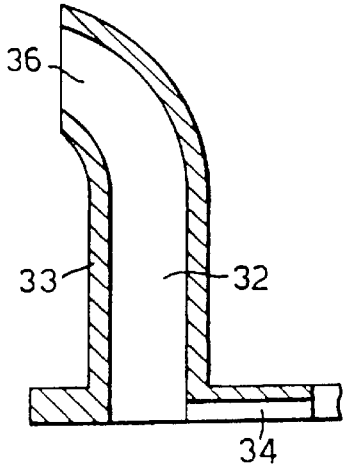
FIG. 4 shows a detailed view of the channel along line IV—IV of FIG. 3.
Figure 3:
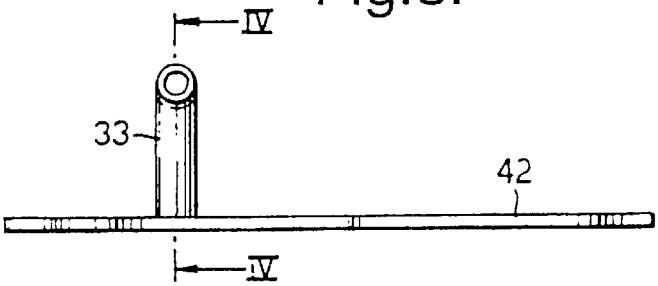
FIG. 3 shows a side view of the spacer of FIG. 2.
Figure 5:
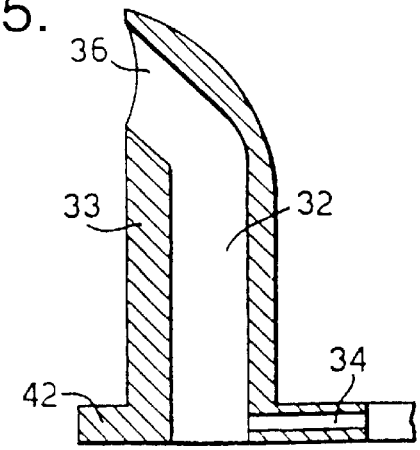
FIG. 5 shows another embodiment of the channel opening in accordance with FIG. 4.

The opening 36 of the compensating channel 32 into the mixing passage 12 is directed against the direction of flow in the mixing passage 12 in that the pipe 33 is angled in this direction. FIG. 4 shows an embodiment where the angle is formed by a gentle bend. FIG. 5 shows another embodiment of the angle in which the channel has a certain direction from the opening before changing direction via a somewhat sharper bend. In the illustrated embodiment the channel 32 has a circular cross section. In addition, the channel 32 is preferably provided with a choke 34 at the inlet to the compensating chamber 30. At the inlet 38 to the mixing passage 12, a suction bend 40 is arranged, which is connected to an air filter (not shown).

During operation air flows through the filter and down into the suction bend 40. The air then flows through the mixing passage 12 and into the motor. Due to the design of the mixing passage 12 a vacuum occurs which sucks fuel in via the distributors 28 producing a fuel/air mixture which is ignited in the combustion chamber of the motor. When fuel is sucked out of the fuel chamber 22 a vacuum occurs there which causes the diaphragm 24 to move up in FIG. 1 and activate the needle valve 20 via the lever arm 26 so that the fuel chamber 22 is filled with fuel and the pressure equalised. The pressure on the other side of the diaphragm i.e. in the compensating chamber 30 is not atmospheric pressure but the pressure in the inlet of the mixing passage 12. The vacuum in the inlet opening 38 increases with increasing contamination of the air filter, but thanks to channel 32 this is compensated for by the vacuum activating the diaphragm 24 so that it moves down in FIG. 1, and, via lever arm 26, adjusts the needle valve 20 upwards thereby reducing the fuel supply. This arrangement prevents the fuel mixture becoming richer with increased pollution of the air filter.

In accordance with a conceivable embodiment of the channel, FIGS. 2–5, it is manufactured in the form of a pipe 33 made of a plastic material in one piece with a flat plastic spacer 42 which is placed between the cover 31 and the carburettor casing 10, FIG. 1. Between the channel 32 and the compensating chamber 30, a slot 34 is arranged, FIG. 4, said slot forming a channel together with the cover. The slot is of much smaller area than channel 32 and thus functions as a choke. The channel 32 can of course also be formed as a drilled hole, FIG. 5. Due to this design, an easily-assembled compensating channel is obtained which does not rotate vis-à-vis the carburettor casing. The channel can therefore be assembled with a high degree of precision with regard to the direction of flow in the mixing passage, i.e. incorrect assembly is not possible. Furthermore, the channel cannot turn during operation and thereby impair the compensating properties. The carburettor only has to be modified in such a way that a through hole is drilled from the underside of the carburettor casing to the mixing passage 12. This through hole is preferably perpendicular to the mixing passage, partly because of the design of the carburettor casing, and partly to facilitate manufacturing of the through hole and the compensating components. A variation of the compensating insert is designing the channel to be integrated with the cover instead of the spacer and forming chokes in the cover in a suitable manner.

Figure 6:
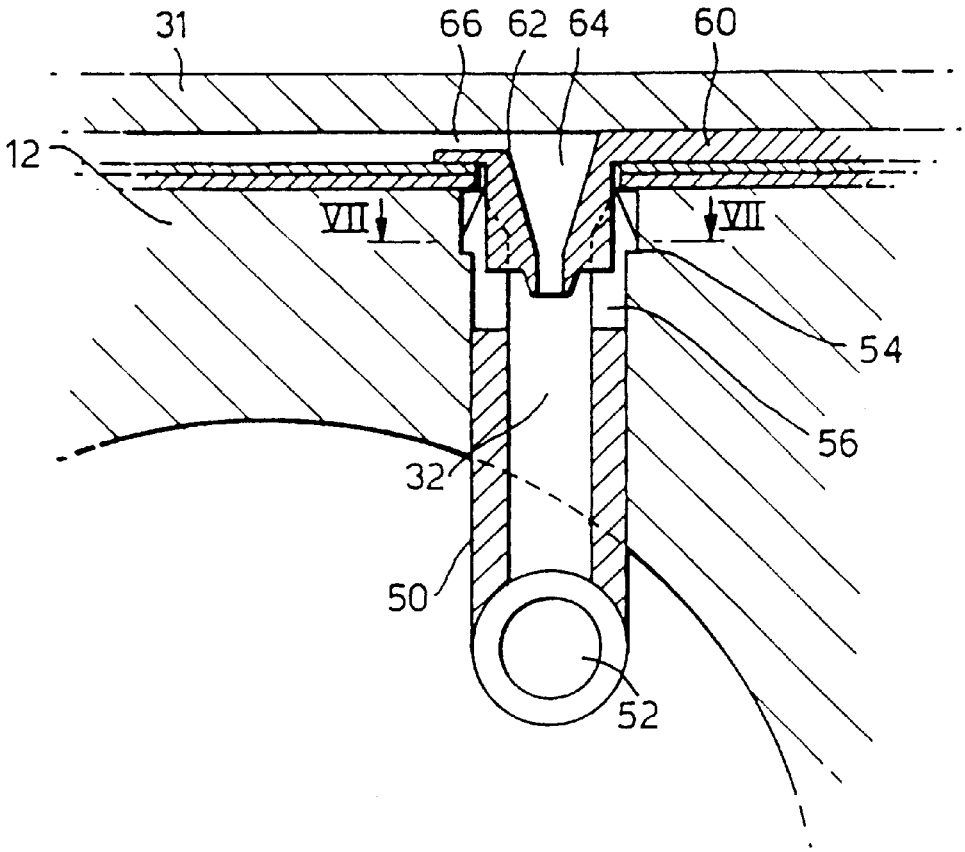
FIG. 6 shows a detailed view of another embodiment of the compensating unit.
Figure 7:
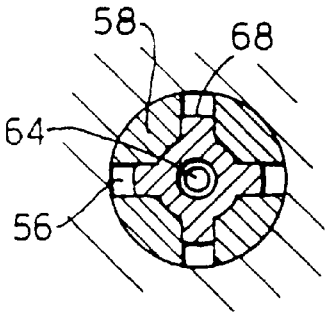
FIG. 7 shows a view along line VII—VII of FIG. 6.
Figure 8:
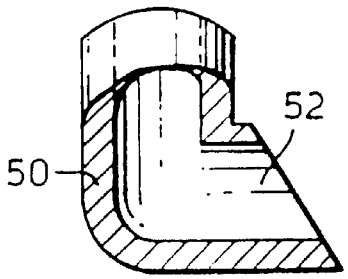
FIG. 8 shows a detailed view of the opening in the channel according to FIG. 6.

Another embodiment of the channel is shown in FIGS. 5–7. The end of the compensating pipe 50 is slightly conical and has a fold or edge 54. The end is also provided with longitudinal slits 56 which allow the tongues 58 formed between the slits 56 to be radially elastic. A holder section 60 in the form of a spacer is intended to be placed between the carburettor casing 10 and the cover 31. The holder section 60 is provided with an attachment in the form of a plug 62 with a through hole 64. Between the through hole 64 and the compensating chamber 30 there is arranged a choke 66 in the form of a groove or a through hole. The plug 62 is arranged with longitudinal tongues or guides 68 the width of which corresponds to the width of the slits 56.

In this embodiment the compensating pipe 50 is inserted into the through hole in the carburettor casing from the mixing passage. At the lower end the through hole in the carburettor casing is slightly widened so that a projection is formed. When the channel pipe has been pressed in to a certain extent the tongues 58 and their edges 54 spring out and rest against the projection, which prevents the pipe from moving back Preferably the outside of the compensating pipe is suitably sealed against the walls of the through hole. The holder section 60 is placed in such a way that its plug 62 is pressed down into the compensating pipe 50. The plug tongues 68 are thereby guided into the slits of the compensating pipe 50 so that a locking against rotation of the pipe 50 is obtained. The side walls of the plug 62 also press against the pipe tongues which prevents them from moving radially.

With this design it is possible to attach channel pipes, the ends of which in the mixing passage are too large or are shaped in such a way that they cannot be inserted through the through hole in the carburettor casing. In this way greater freedom is obtained for designing the opening of the compensating pipe as well as satisfying the requirement for rotation locking assembly. It is thus conceivable for the compensating pipe to be formed with a section 52, FIG. 7, which is mainly parallel to the direction of flow before the pipe bends. In conjunction with this it is also possible to use compensating pipes which do not extend the whole way through the carburettor casing but only extend a short way down into the through hole and are locked in this in a suitable manner, and that a spacer or seal including a choke is arranged between the carburettor casing and the cover. The remaining section of the compensating channel is formed of the through hole itself in this case.

Figure 9:
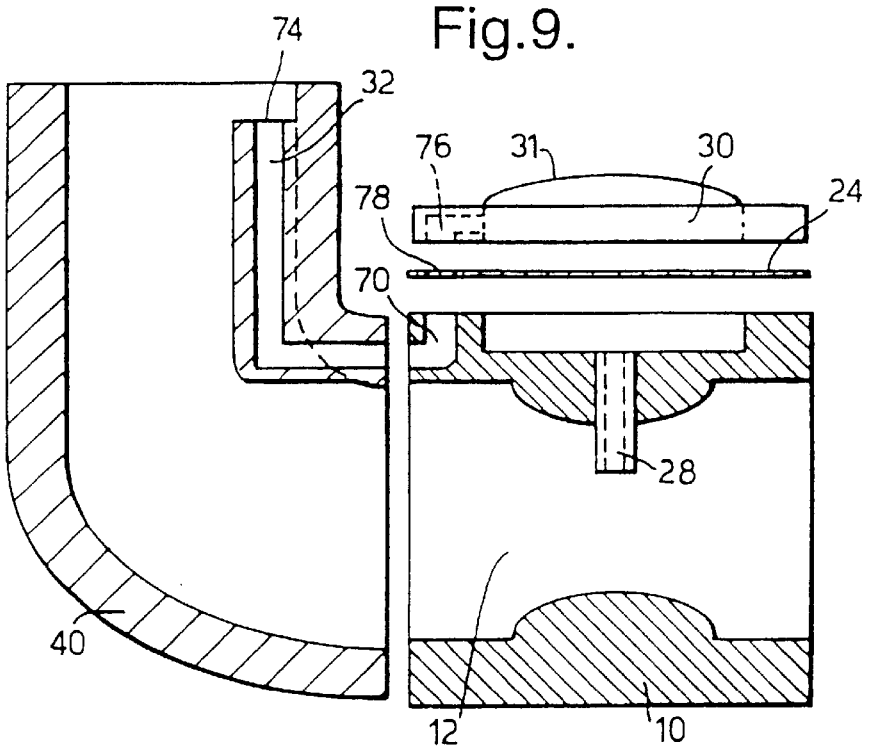
FIG. 9 shows a detailed view of a third embodiment of the compensating unit.
Figure 10:
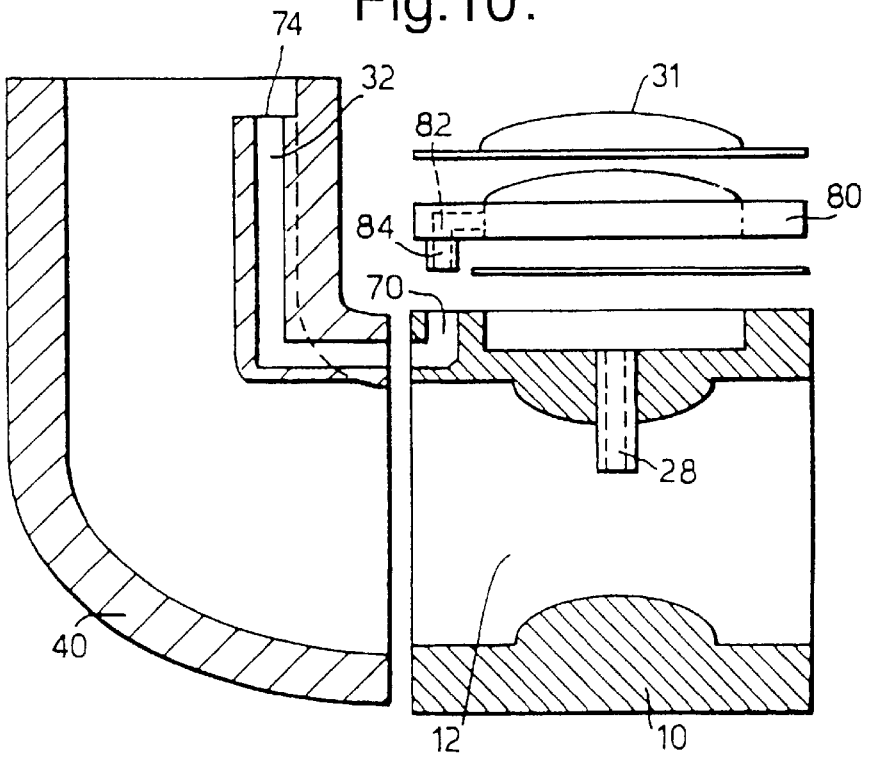
FIG. 10 shows a variant of the embodiment in FIG. 9.
Figure 11:
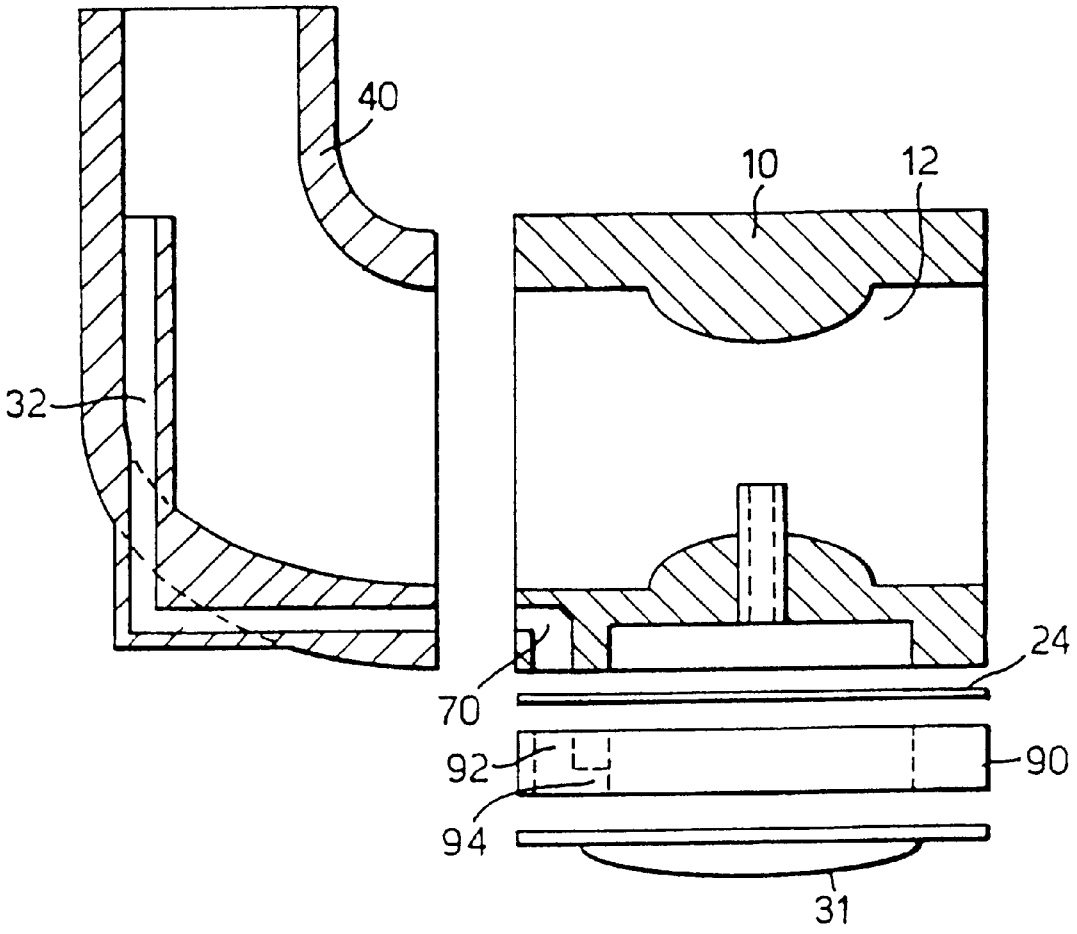
FIG. 11 shows a further variant of the embodiment in FIG. 9.

FIGS. 9–11 show further conceivable variants. In these the opening of the compensating channel has been extended into the suction bend and the channel is designed as a pipe which is integrated into the suction bend. In the embodiment according to FIG. 9, the carburettor casing 10 has a boring 70 with an opening on one of the short sides and an outlet in the vicinity of the compensating chamber 30, i.e. a through hole drilled at an angle. Integrated into the suction bend 40, a compensating passage 32 is arranged, the opening of which 74 is arranged a little way from the mixing passage 12 of the carburettor casing. In the shown embodiment the cover 31 which closes the compensating chamber 30 has a passage 76. The diaphragm 24 also has an opening 78. When the components are assembled, a compensating passage is obtained from the upper section of the suction bend to the compensating chamber by way of the passages 32, 70 and 76 being connected to each other. In this case the diaphragm acts as a seal for the compensating passage in the transition area between the carburettor and the cover. If desired, or necessary, the passage in the cover can be provided with a suitable choke.

In the variant shown in FIG. 10 the carburettor has an intermediate spacer 80 between the cover 31 and the diaphragm/carburettor casing. In the spacer 80, a passage 82 is ranged, which is communicating with the compensating chamber 30 and the boring 70 in the carburettor casing. Sealing of the passage between the spacer and the carburettor casing is obtained in this case by means of a flange 84 with a diameter corresponding to that of the boring 70.

The variant in FIG. 11 is rather similar to the one in FIG. 10 in that a spacer 90 is arranged between the diaphragm/carburettor casing and the cover of the compensating chamber, with the difference that the diaphragm is arranged as a seal and that the passage of the cover is partly a boring 92 and partly a groove 94, where the groove 94 and the cover 31 together form a passage.

In the variants in accordance with FIGS. 9–11 the compensating passage and its inlet are extended slightly from the mixing passage of the carburettor in order to obtain a measuring point with smaller pressure variations so as to achieve more the reliable compensation required for certain motors and applications.

These three variants of the invention also have a simple compensating passage structure with very little encroachment into the carburettor. This structure means that changes can be easily made in the suction bend passage and in the cover or the spacer between the cover and the carburettor casing. In this way the carburettor can be adapted to different motors and/or areas of application. This structure provides simple and secure compensation assembly without the risk of incorrect assembly or leakage. Another advantage is that the carburettor with the above design of compensating passage in its casing can be used for motors which do not require compensation as the cover or spacer can easily be designed without passages, thereby closing the inlet to the compensating chamber.

Empirical tests with a cutting-off machine equipped with several different channel designs and sizes, opening sizes and directions, as well as size, number and location of chokes, showed that the best result for the machine is obtained with a channel having an opening into the mixing passage directed towards the direction of flow with a gentle end, where the plane formed by the edges of the opening was perpendicular to the direction of flow and where the inlet of the compensating chamber was provided with a choke. This embodiment compensated well for contaminated air filters in a broad range, i.e. with relatively constant fuel/air mixtures with increasing falls in pressure. The machine with compensation can therefore be operated at relatively constant output with very contaminated air filters.

The ratio of the choke area to the diaphragm area was 1 to 4000 in the tested case. Depending on the different filter conditions and designs, suction bends and fan systems in machines equipped with the above compensation, it is possible to conceive the choke area/diaphragm area ratio lying within the range 1/500 to 1/10000, and preferable 1/1000 to 1/6000.

It is to be understood that the invention is not limited to the above description and drawings shown, but can be varied within the framework of the following claims. For example, the suction bend can be of a different design and the compensating channel can have a different cross section which is other than circular was well as different extensions into the carburettor casing. The material selection and specific design and placing of compensating units can be selected in many different ways.

What is claimed is:

1. A diaphragm carburetor comprising a carburetor casing (10) having a mixing passage (12) which, at its inlet side (38), is connected to an air filter, and a measuring chamber arranged in the casing, said measuring chamber being partitioned into a fuel chamber (22) and a compensation chamber (30) separated by a control diaphragm (24), whereby air is drawn in from the inlet side (38) and fuel is drawn in from the fuel chamber (22) into the mixing passage (12), the compensating chamber (30) is closed to the surrounding atmosphere but connected to a channel (34), an opening (36) of said channel enters into a space between the air filter and the fuel inlet (28) in the mixing passage (12), wherein said channel (32) is at least partially defined by a pipe (33) extending all the way through the casing (10) from said space to outside said casing, said pipe being adapted for assembly/disassembly from outside of said casing, and said pipe is attached to means (42, 62) for properly orienting and fixing said pipe relative to said casing during assembly.

2. A diaphragm carburetor according to claim 1, wherein said (33) is integrated with a spacer (42) arranged between the carburetor casing (10) and a cover (31), said cover closing off the compensating chamber (30) from the environment.

3. A diaphragm carburetor according to claim 2, wherein said pipe (33) is integrated with said cover (31).

4. A diaphragm carburetor according to claim 1, wherein the opening (36) of the channel (32) is bent against the direction of flow at its connection to the mixing passage (12).

5. A diaphragm carburetor according to claim 4, wherein, from its opening, part of the channel (32) extends at an angle against the direction of flow before then passing via a bend into its stretch into the compensating chamber (30).

6. A diaphragm carburetor according to claim 4, wherein said bend is designed as a gentle transition.

7. A diaphragm carburetor according to claim 4, wherein a plane formed by the edges of the opening (36) of the channel (32) is generally perpendicular to the direction of flow.

8. A diaphragm carburetor according to claim 1, wherein at least one choke (34) is arranged in the channel (32).

9. A diaphragm carburetor according to claim 8, wherein there is only one choke (34) and said choke is disposed at the inlet to the compensating chamber.

10. A diaphragm carburetor comprising a carburetor casing (10) having a mixing passage (12) which, at its inlet side (38), is connected to an air filter, and a measuring chamber arranged in the casing, said measuring chamber being partitioned into a fuel chamber (22) and a compensation chamber (30) separated by a control diaphragm (24), whereby air is drawn in from the inlet side (38) and fuel is drawn in from the fuel chamber (22) into the mixing passage (12), the compensating chamber (30) is closed to the surrounding atmosphere but connected to a channel (34), an opening of said channel (36) enters into a space between the air filter and the fuel inlet (28) in the mixing passage (12), wherein said channel (32) is at least partially defined by a pipe (50), said pipe being provided with attachment means (54, 58) at its end opposite the opening (36), and wherein connecting means (60, 62) is arranged between the carburetor casing (10) and a cover (31), which closes off the compensating chamber (30) from the environment, said attachment means (54, 58) of said pipe (50) being arranged for connection to the connecting means to achieve locking between them, and the connecting means (60, 62) is provided with a passage between the channel (32) and the compensating chamber (30).

11. A diaphragm carburetor according to claim 10, wherein said connecting means (60, 62) comprises a spacer (60) adapted for disposal between the carburetor casing (12) and the cover (31), the spacer has a plug, (62) with a through hole (64) and a passage (66) in the spacer between the hole (64) and the compensating chamber (30), the plug (62) has a rotation locking means (68) in the form of longitudinal tongues (68), the pipe (50) is provided with a locking element in the form of longitudinal slits (56), sections between the slits form elastic tongues (58) the outer surfaces of which are provided with edges (54) such that on assembly, the pipe (50) is placed on the spacer's plug so that the edges (54) of the slits engage in the carburetor casing (12), the tongues (68) of the plug (62) fit into the slits (56) of the pipe and the plug presses the tongues (58) of the pipe (50) against the carburetor casing so that locking of the pipe (50) and the spacer (60) is obtained.

12. A diaphragm carburetor according to claim 10, wherein the opening (36) of the channel (32) is bent against the direction of flow at its connection to the mixing passage (12).

13. A diaphragm carburetor according to claim 12, wherein, from its opening, part of the channel (32) extends at an angle against the direction of flow before then passing via a bend into its stretch into the compensating chamber (30).

14. A diaphragm carburetor according to claim 12, wherein said bend is designed as a gentle transition.

15. A diaphragm carburetor according to claim 12, wherein a plane formed by the edges of the opening (36) of the channel (32) is generally perpendicular to the direction of flow.

16. A diaphragm carburetor according to claim 10, wherein at least one choke (34) is arranged in the channel (32).

17. A diaphragm carburetor according to claim 16, wherein there is only one choke (34) and said choke is disposed at the inlet to the compensating chamber.

18. A diaphragm carburetor comprising a carburetor casing (10) having a mixing passage (12) which is connected at its inlet side (38) to an air filter, and a measuring chamber arranged in the casing, said measuring chamber being partitioned into a fuel chamber (22) and a compensating chamber (30) separated by a control diaphragm (24), whereby air is drawn in from the inlet side (38) and fuel is drawn in from the fuel chamber (22) into the mixing passage (12), the compensating chamber (30) is closed off to the surrounding atmosphere but is connected to a channel (32) with an opening (36) which enters into a space between the air filter and the fuel inlet (28) in the mixing passage (12), wherein a part of the channel (32) is integrated in a bend of a suction pipe (40) arranged between the carburetor and the air filter, and the opening (36) of the channel enters into the suction pipe (40).

19. A diaphragm carburetor according to claim 18, wherein the opening is arranged in the vicinity of the air filter and directed against the direction of flow.

20. A diaphragm carburetor according to claim 18, wherein the channel (32) in the suction pipe (40) communicates with a passage (70) in the carburetor casing which, in turn, communicates with one of a passage (76) in the cover (31) which closes the compensating chamber and a passage (82, 92, 94) in a spacer arranged between the cover and the carburetor casing, said passage (76, 82, 92, 94) communicating with the compensating chamber.

* * * * *